US007091807B2

(12) United States Patent
Tanimizu et al.

(10) Patent No.: US 7,091,807 B2
(45) Date of Patent: Aug. 15, 2006

(54) ELECTROMAGNETIC DEVICE

(75) Inventors: Toru Tanimizu, Ibaraki (JP); Toyohisa Tsuruta, Shizuoka (JP); Toshimasa Fukai, Shizuoka (JP); Akira Nishijima, Shizuoka (JP); Hiroshi Fujimaki, Shizuoka (JP); Yoshiyuki Tanimizu, Shizuoka (JP)

(73) Assignees: Japan AE Power Systems Corporation, Tokyo (JP); Technical Consulting Tanimizu Ltd., Hitachi (JP)

( * ) Notice: Subject to any disclaimer, the term of this patent is extended or adjusted under 35 U.S.C. 154(b) by 0 days.

(21) Appl. No.: 10/914,504

(22) Filed: Aug. 10, 2004

(65) Prior Publication Data

US 2005/0057103 A1 Mar. 17, 2005

(30) Foreign Application Priority Data

| | | |
|---|---|---|
| Aug. 12, 2003 | (JP) | 2003-292242 |
| Nov. 19, 2003 | (JP) | 2003-388836 |
| Jun. 8, 2004 | (JP) | 2004-170283 |
| Jun. 8, 2004 | (JP) | 2004-170284 |
| Jun. 8, 2004 | (JP) | 2004-170285 |
| Jul. 14, 2004 | (JP) | 2004-207800 |

(51) Int. Cl.
*H01F 7/08* (2006.01)

(52) U.S. Cl. ..... 335/220; 335/234

(58) Field of Classification Search ..... 335/220–237, 335/256, 266, 250–255; 310/12–14; 251/129.01–129.19
See application file for complete search history.

(56) References Cited

U.S. PATENT DOCUMENTS

| | | | | |
|---|---|---|---|---|
| 2,446,855 A | | 8/1948 | Seibel | |
| 3,859,547 A | * | 1/1975 | Massie | 310/14 |
| 4,539,542 A | | 9/1985 | Clark | |
| 4,686,501 A | | 8/1987 | Palmeir et al. | |
| 5,144,272 A | | 9/1992 | Nishimura | |
| 5,200,728 A | | 4/1993 | Patterson et al. | |
| 6,373,363 B1 | * | 4/2002 | Spakowski et al. | 335/256 |

FOREIGN PATENT DOCUMENTS

| | | |
|---|---|---|
| EP | 1 076 167 A2 | 2/2001 |
| GB | 2 142 780 A | 1/1985 |
| JP | 61-77311 A | 4/1986 |
| JP | 5-55029 A | 3/1993 |
| JP | 11-204329 A | 7/1999 |
| JP | 2002-8498 A | 1/2002 |

OTHER PUBLICATIONS

Christian Chillet et al., "Design-Oriented Analytical Study of a Linear Electromagnetic Actuator by Means of a Reluctance Network", IEEE Transactions on Magnetics, Jul. 2001, pp. 3004-3011, vol. 37, No. 4.

* cited by examiner

*Primary Examiner*—Lincoln Donovan
(74) *Attorney, Agent, or Firm*—Foley & Lardner LLP

(57) ABSTRACT

An attraction coil, a repulsion coil and a plunger are disposed in a magnetic path of an electromagnetic device. An starting flux generating section is disposed between the attraction coil and the repulsion coil in the magnetic path. A magnetic flux of the starting flux generating section is repulsed magnetically by a magnetic flux of the repulsion coil at a part of the magnetic path to start the plunger. The plunger is attracted to one of first and second magnetic path parts by electromagnetic forces generated from magnetic fluxes of the attraction coil and the repulsion coil.

21 Claims, 12 Drawing Sheets

ELECTROMAGNETIC DEVICE

BACKGROUND OF THE INVENTION

The present invention relates to an electromagnetic device for starting a plunger by magnetic flux generated by an electromagnetic coil.

Japanese Patent Application Publications Nos. H05 (1993)-55029 and 2002-8498 disclose examples of existing bidirectional electromagnetic devices. A bidirectional electromagnetic device of one of these examples includes a magnetic path, two exciting coils and a plunger surrounded by the magnetic path. The magnetic path includes a first magnetic path part, a second magnetic path part, a leg part, central magnetic path parts, and an intermediate magnetic path part. The leg part connects the first magnetic path part and the second magnetic path part. The intermediate magnetic path part projects radially inward from an intermediate part of the tubular leg part. The central magnetic path parts each extend inwardly in parallel with the leg part from central parts of the first magnetic path part and the second magnetic path part substantially halfway to the intermediate magnetic path part. The two exciting coils are disposed in the thus-structured magnetic path. The plunger is attracted to or detached from the central magnetic path parts by electromagnetic forces of the exciting coils.

In this example, when one of the exciting coils is supplied with exciting current, the plunger is actuated upward by a magnetomotive force from the first magnetic path part, and is attracted to the upper central magnetic path part. Then, when the supply of the exciting current to the one of the exciting coils is stopped, and the other of the exciting coils is supplied with exciting current, the plunger is actuated downward by a magnetomotive force from the second magnetic path part, and is attracted to the lower central magnetic path part.

For the actuation of the bidirectional electromagnetic device of this example, the magnitude of the magnetomotive force, which is a product of the winding number of each of the exciting coils and the supplied current, is so determined as to correspond to a force required to be generated for starting the plunger; and the shape and size of the plunger, the magnetic path and other elements are so determined as to prevent a saturation of magnetic flux generated by the magnetomotive force.

SUMMARY OF THE INVENTION

It is an object of the present invention to provide an electromagnetic device having a small size and achieving a large magnetic attraction by using a small amount of energy to start a plunger, and by changing leakage magnetic flux to effective magnetic flux.

According to one aspect of the present invention, an electromagnetic device including: a magnetic path including first and second magnetic path parts, and a leg part connecting the first and second magnetic path parts; an attraction coil disposed in the magnetic path and arranged to generate a magnetic flux; a repulsion coil disposed in the magnetic path and arranged to generate a magnetic flux; a plunger disposed in the magnetic path and arranged to move to and from one of the first and second magnetic path parts by at least one of electromagnetic forces of the attraction coil and the repulsion coil; and a starting flux generating section disposed between the attraction coil and the repulsion coil in the magnetic path, and arranged to generate a magnetic flux so that the magnetic flux of the starting flux generating section and the magnetic flux of the repulsion coil repulse magnetically each other at a part of the magnetic path to start the plunger.

The other objects and features of this invention will become understood from the following description with reference to the accompanying drawings.

DETAILED DESCRIPTION OF THE INVENTION

(1) EMBODIMENT 1

Figure 1:
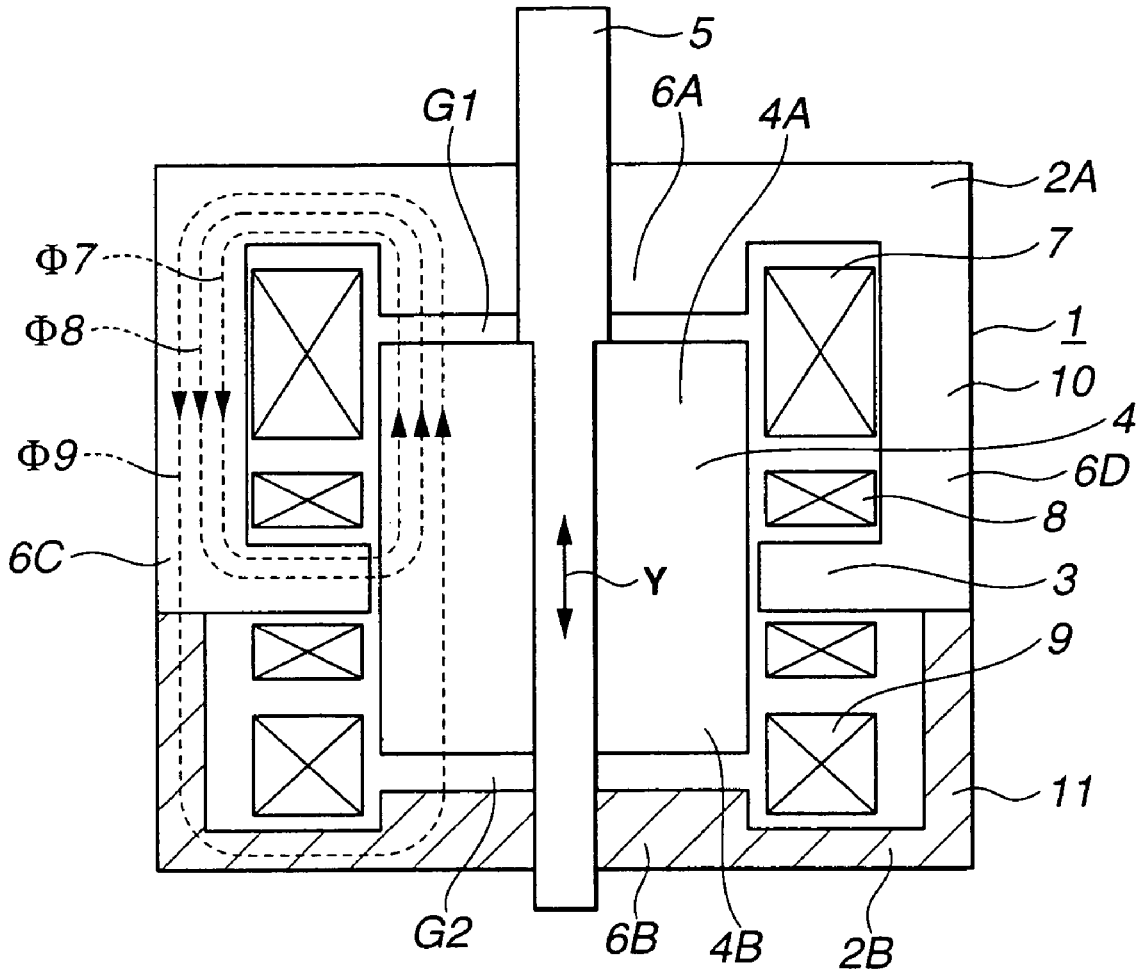
FIG. 1 is a sectional side view of an electromagnetic device using a magnetic repulsion effect according to a first embodiment of the present invention upon setting flows of magnetic fluxes.

FIG. 1 is a sectional view showing a structure of an electromagnetic device (or actuator) using a magnetic repulsion effect. As shown in FIG. 1, the electromagnetic device according to a first embodiment of the present invention includes a magnetic path 1 (or casing defining a magnetic path), an attraction coil 7, starting coils (or actuation coils) 8 forming a starting flux generating section, a repulsion coil 9, and a plunger 4. The magnetic path 1 includes a first magnetic path part 2A and a second magnetic path part 2B at upper and lower ends, respectively, and an intermediate magnetic path part 3 located between the first magnetic path part 2A and the second magnetic path part 2B. The intermediate magnetic path part 3 projects radially inward from an inner circumference of the magnetic path 1 between the first and second magnetic path parts 2A and 2B. The first magnetic path part 2A and the second magnetic path part 2B are united in the magnetic path 1. Thus, magnetically, the magnetic path 1 is formed by two magnetic sections of a first magnetic path 10 and a second magnetic path 11. Structurally, the first magnetic path 10 and the second magnetic path 11 are formed by the first magnetic path part 2A and the second magnetic path part 2B connected by a side leg part having portions 6C and 6D. The casing defining the magnetic path 1 is shaped like a tube or a hollow cylinder.

The plunger 4 is disposed in the magnetic path 1. A plunger rod 5 extends through the plunger 4 and projects from upper and lower ends 4A and 4B of the plunger 4 outwardly through central magnetic path parts 6A and 6B. The central magnetic path parts 6A and 6B are formed integrally with the first magnetic path part 2A and the second magnetic path part 2B, respectively. Each of the central magnetic path parts 6A and 6B projects axially inward from a central part of the first or second magnetic path part 2A or 2B. Besides, the plunger rod 5 may be inserted directly through rod holes formed in the first magnetic path part 2A and the second magnetic path part 2B. The plunger 4 is moved in axial directions indicated by an arrow Y by magnetomotive forces of the coils 7, 8 and 9. The plunger 4 and each of the central magnetic path parts 6A and 6B form a gap G1 or G2. The magnetic path 1 and the plunger 4 are made of magnetic materials.

The attraction coil 7 and the repulsion coil 9 are disposed in the magnetic path 1. The attraction coil 7 is positioned between the intermediate magnetic path part 3 and the first (upper) magnetic path part 2A including the central magnetic path part 6A. The repulsion coil 9 is positioned between the intermediate magnetic path part 3 and the second (lower) magnetic path part 2B including the central magnetic path part 6B. Each of the attraction coil 7 and the repulsion coil 9 is formed by a conductor wound around a line extending in the axial direction. The starting coil 8 is provided on the intermediate magnetic path part 3.

Each of the starting coils 8 is formed by a conductor wound around a radial line extending perpendicular to the axial direction of the coils 7 and 9. The starting coils 8 of the starting flux generating section may be replaced by one or more permanent magnets or any means which can generate magnetic flux. When the starting flux generating section 8 is provided directly in the magnetic path 1, the intermediate magnetic path part 3 may be omitted. The plunger 4 is disposed in an area surrounded by the attraction coil 7, the repulsion coil 9 and the starting flux generating section 8.

The starting coil 8 and the repulsion coil 9 are arranged to generate magnetomotive forces approximate to each other. In other words, the magnetomotive forces of the starting coil 8 and the repulsion coil 9 cause magnetic fluxes magnetically repulsing each other in respective directions to start motion of the plunger 4 at a part of the magnetic path 1. Each of the starting coil 8 and the repulsion coil 9 is so arranged that the magnetomotive force is smaller than or equal to the magnetomotive force of the attraction coil 7.

In detail, parts of the magnetic path 1 opposing the attraction coil 7 and the starting coil 8, the first magnetic path part 2A and the intermediate magnetic path part 3 compose the first magnetic path 10. A part of the magnetic path 1 opposing the repulsion coil 9, and the second magnetic path part 2B compose the second magnetic path 11. Thus, as mentioned above, the magnetic path 1 is composed of the first magnetic path 10 and the second magnetic path 11. The first magnetic path 10 is arranged to have a sectional area larger than a sectional area of the second magnetic path 11. Thus, the first magnetic path 10 has a magnetic reluctance smaller than a magnetic reluctance of the second magnetic path 11. The first magnetic path 10 and the second magnetic path 11 are independent sections, and detachable from each other. In this example, the first magnetic path 10 and the second magnetic path 11 abut each other to form the magnetic path 1.

Next, a description will be given, with reference to FIG. 1 to FIG. 5, of an operation of the electromagnetic device utilizing magnetic repulsion. As shown in FIG. 1, as an initial setting of flows of magnetic fluxes, the attraction coil 7, the starting coil 8 and the repulsion coil 9 are supplied with electric current so as to generate an attraction flux Φ7, an starting flux Φ8 and a repulsion flux Φ9 flowing in the same direction.

Figure 2:
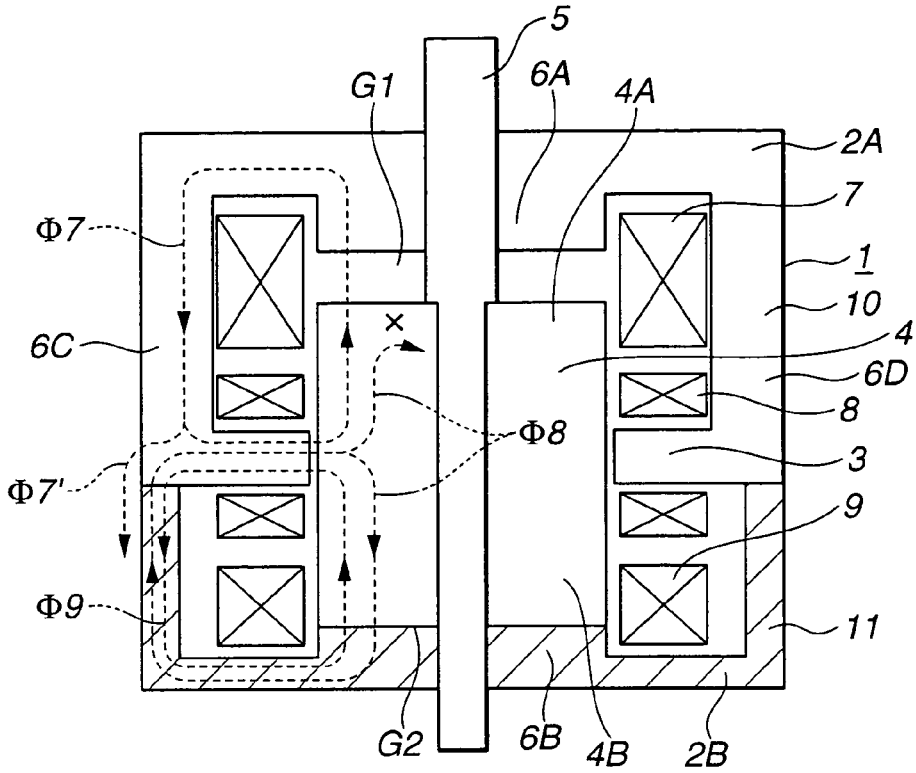
FIG. 2 is a sectional view of the electromagnetic device of FIG. 1 in an attraction actuation start position, showing progress of the flows of the magnetic fluxes.

FIG. 2 shows the electromagnetic device in an attraction actuation start position in which the plunger 4 abuts on the second central magnetic path part 6B, and thus the gap G1 is wider than the gap G2. In this state, the attraction flux Φ7, the starting flux Φ8 and the repulsion flux Φ9 flow, as described hereinafter.

The attraction flux Φ7 flows mainly in the first magnetic path 10, and also flows, as attraction flux Φ7', in the second magnetic path 11. Since the second magnetic path 11 is a bottleneck path having the magnetic reluctance larger than the magnetic reluctance of the first magnetic path 10, the amount of the attraction flux Φ7 is larger than the amount of the attraction flux Φ7' (Φ7>Φ7'). Since the gap G1 is wider than the gap G2 (G1>G2), and thus the gap G2 has a smaller magnetic reluctance than a magnetic reluctance of the gap G1, most of the starting flux Φ8 reverses its course of the flow, as indicated by a curved arrow X in FIG. 2, toward the lower end 4B of the plunger 4 in the second magnetic path 11 where the magnetic reluctance is smaller. The direction of this reverse flow of the starting flux Φ8 is opposite to a direction in which the starting flux Φ8 flows eventually in an attraction completion position in which the gap G1 between the plunger 4 and the first central magnetic path part 6A is reduced. The repulsion flux Φ9 flows mainly in the second magnetic path 11.

The magnetomotive forces of the starting coil 8 and the repulsion coil 9 are set to be equivalent or approximate to each other. Accordingly, though a large portion of the repulsion flux Φ9 flows across the gap G2 formed opposite the repulsion coil 9 in the second magnetic path 11 between the central magnetic path part 6B and the lower end 4B of the plunger 4, as shown in FIG. 3, the starting flux Φ8 reversing to the lower end 4B and the repulsion flux Φ9 flowing in the central magnetic path part 6B confront each other on both sides of the gap G2, and thereby cause repulsion in a manner similar to homopolar repulsion between magnets.

Figure 3:
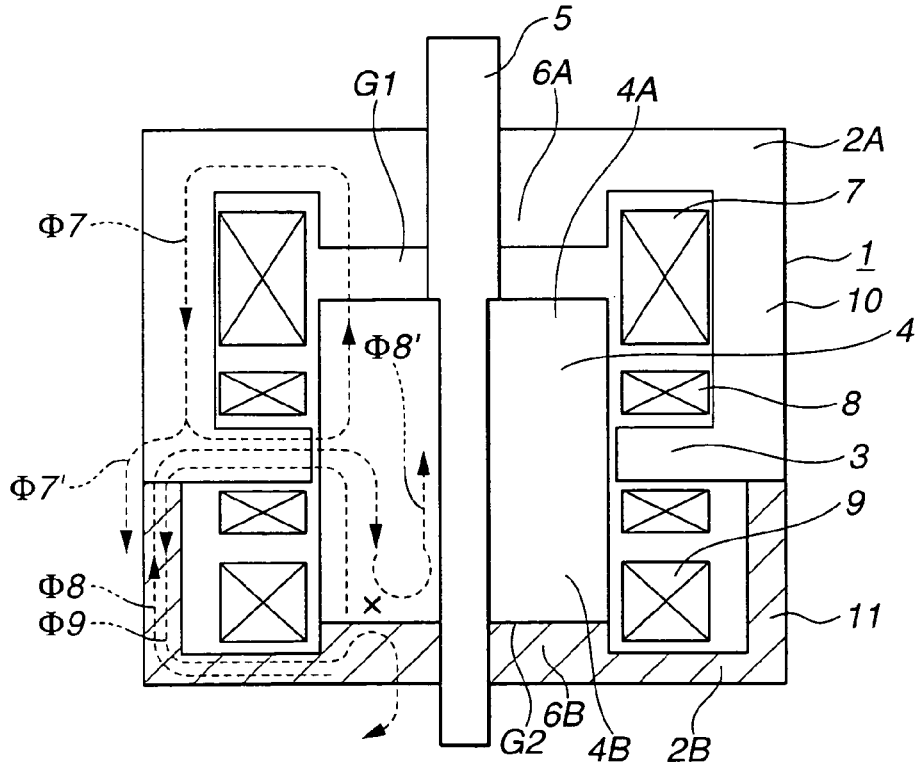
FIG. 3 is a sectional view of the electromagnetic device of FIG. 2 in the attraction actuation start position, showing repulsion of the magnetic fluxes.

Then, the repulsion between the starting flux Φ8 and the repulsion flux Φ9 forces the starting flux Φ8 to turn as indicated by a curved arrow X in FIG. 3, and flow as starting flux Φ8' toward the first magnetic path 10.

Figure 4:
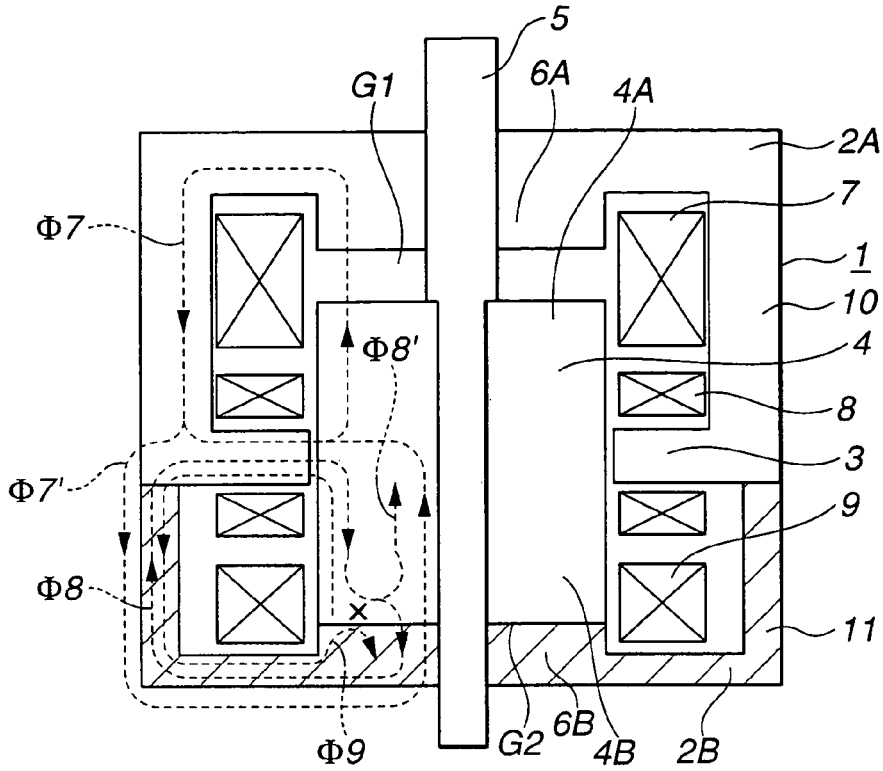
FIG. 4 is a sectional view of the electromagnetic device of FIG. 3 in the attraction actuation start position, showing progress of the repulsed magnetic fluxes.

In this case, the plunger 4 receives an actuation force produced by the starting flux Φ8' repulsed by the repulsion flux Φ9 at the gap G2, and an attraction force formed by the attraction flux Φ7 flowing in the first magnetic path 10 across at the gap G1, as shown in FIG. 4.

When the gap G2 is minimum, the attraction flux Φ7' branches off from the attraction flux Φ7 at a ratio of the magnetic reluctances between the attraction fluxes Φ7 and Φ7', flows in the bottleneck path of the second magnetic path 11, and then joins the repulsion flux Φ9 in the repulsion to the starting flux Φ8 at the gap G2. However, the ratio of the magnetic reluctances between the attraction fluxes Φ7 and Φ7' varies as the gap G2 increases immediately after the start of the plunger 4. In accordance with the thus-varying ratio, the attraction Φflux 7' decreases, and the attraction flux Φ7 increases. The attraction flux Φ7 increases further by a large current supplied to the attraction coil 7 while magnetic fluxes counteract one another and delay the start of the actuation of the plunger 4, as described hereinafter.

If the attraction coil is excited in the above-described example of the existing bidirectional electromagnetic device of the earlier technology, the amount of the attraction flux Φ7' flowing in the second magnetic path becomes considerably large since a part corresponding to the second magnetic path 11 has a relatively large sectional area and thus has a relatively small magnetic reluctance. When the amount of the attraction flux Φ7' is considerably large and resides in the gap G2 , the attraction flux Φ7' flowing in the gap G2 applies an attraction force between the lower end 4B of the plunger 4 and the central magnetic path part 6B, and thereby hinders a normal operation of the plunger 4, because a difference between the attraction force at the gap G1 and the attraction force at the gap G2 forms the force actuating the plunger 4. Additionally, since the position of repulsion to magnetic flux of the permanent magnet cannot be fixed, the repulsion is highly likely to occur at a part other than the gap G2. Therefore, the above-described example of the existing bidirectional electromagnetic device is not capable of achieving a stable force for actuating the plunger 4.

Figure 5:
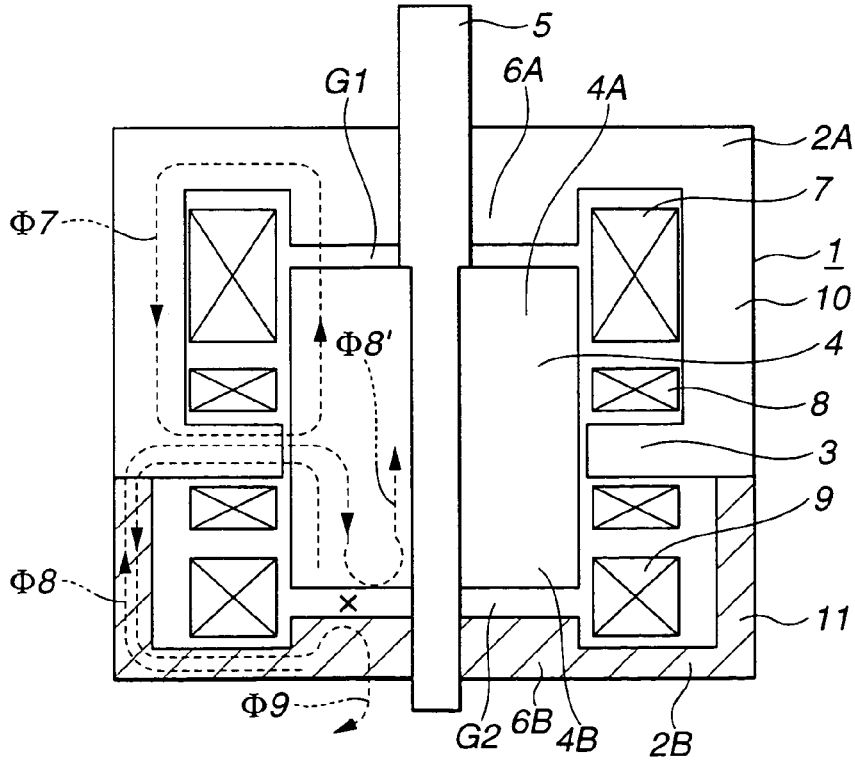
FIG. 5 is a sectional view of the electromagnetic device, showing progress of the repulsed magnetic fluxes in a state where a plunger is moving from the attraction actuation start position of FIG. 4.

Thus, the attraction flux Φ7 and the starting flux Φ8' together form the magnetic attraction force for the plunger 4 from the start of the actuation, and move the plunger 4 with the strong actuating force, as shown in FIG. 5.

As described above, the magnetic repulsion increases the force actuating the plunger 4 at the start of the actuation. Even after the start of the actuation, the repulsion flux Φ9 in the repulsion coil 9 does not change greatly since the point of repulsion is in the repulsion coil 9; thus, the repulsion flux Φ9 continues to repulse and reverse the starting flux Φ8 of the starting coil 8 until the end of the actuating operation, and thereby continues to add the starting flux Φ8' to the attraction flux Φ7 of the attraction coil 7. In this course, since the attraction coil 7, the starting coil 8 and the repulsion coil 9 are arranged to be supplied with electric current so that the attraction flux Φ7, the starting flux Φ8 and the repulsion flux Φ9 flow in the same direction, as shown in FIG. 1, all of the magnetomotive forces applied to the attraction coil 7, the starting coil 8 and the repulsion coil 9 form the force actuating the plunger 4.

Then, the plunger 4 moves as shown in FIG. 5, and the upper end 4A of the plunger 4 abuts against the central magnetic path part 6A at the end of the actuating operation of the electromagnetic device.

Thus, from the start of the actuation of the plunger 4, the electromagnetic device of the present invention moves the plunger 4 by using the actuation force of the starting flux Φ8' repulsed by the repulsion flux Φ9, and the attraction force increased by the merger of the starting flux Φ8' to the attraction flux Φ7. Therefore, the electromagnetic device can use the thus-enlarged force to actuate the plunger 4 from the start of the actuation. Besides, since the electromagnetic device of the present invention obtains the actuation force initially required for actuating the plunger at the start of the actuation from another coil (the starting coil 8 in this example), the electromagnetic device of the present invention can operate with a small amount of the magnetomotive force of the attraction coil 7, and thereby can reduce a shock at the end of the actuating operation.

Figure 6:
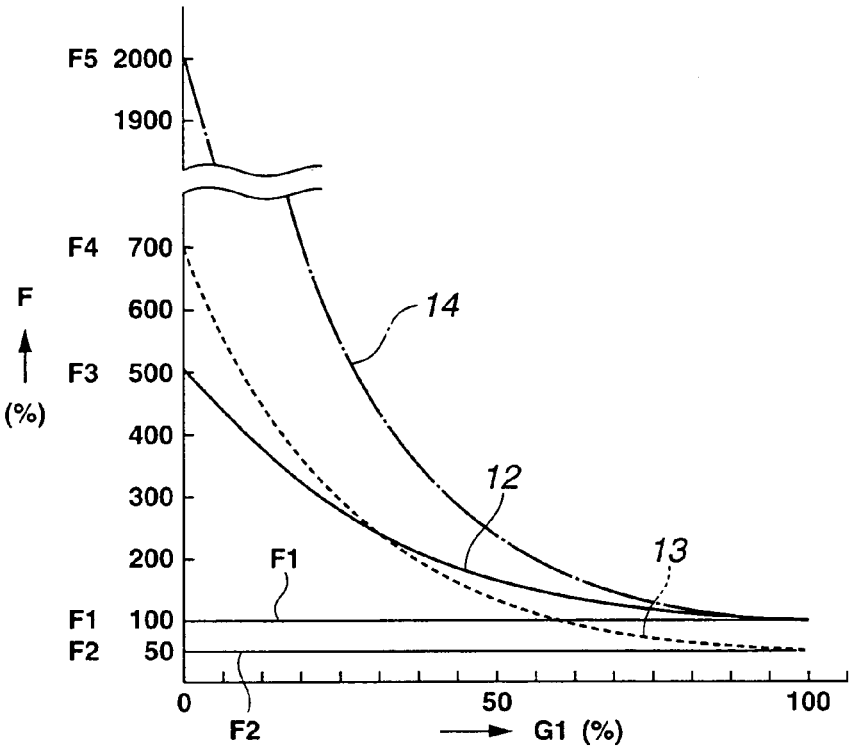
FIG. 6 is a characteristic diagram showing operating characteristic curves regarding a gap and a force actuating the plunger in the electromagnetic device according to the present invention.

FIG. 6 is an operating characteristic diagram showing operating characteristic curves regarding the gap G1 and the force (F) actuating the plunger 4. Assuming that a characteristic curve 12 of the present invention indicates an actuating force F1 of 100% at a 100% position of the gap G1, the characteristic curve 12 indicates an actuating force F3 of 500% at a 0% position of the gap G1. The ratio of the actuating force F3 to the actuating force F1 is five.

By contrast, if the magnetomotive forces of the same magnitude as in the present invention are applied in the above-described example of the existing bidirectional electromagnetic device, a characteristic curve 13 of the existing device indicates an actuating force F2 of 50% at the 100% position of the gap G1, and indicates an actuating force F4 of 700% at the 0% position of the gap G1. The ratio of the actuating force F4 to the actuating force F2 is 14.

Thus, the ratio of the characteristic curve 13 to the characteristic curve 12 is ½ at the 100% position of the gap G1, and 1.4 at the 0% position of the gap G1. In other words, when the magnetomotive forces of the same magnitude, or the same energy, are applied, the electromagnetic device of the present invention can achieve two times as large as the initial actuation force at the start of the actuation of the plunger at the 100% position of the gap G1, and can reduce the shock by the rate of 0.71 at the end of the actuating operation at the 0% position of the gap G1.

Further, if the magnitudes of the magnetomotive forces applied in the existing bidirectional electromagnetic device are increased from the same magnitude of the present invention, a characteristic curve 14 of the existing device indicates the same initial actuation force as in the present invention, i.e., the same actuating force F1 of 100% at the 100% position of the gap G1. However, the characteristic curve 14 indicates a large actuating force F5 of 2000% at the 0% position of the gap G1. The ratio of the actuating force F5 to the actuating force F1 is 20. Thus, although the ratio of the characteristic curve 14 to the characteristic curve 12 is 0 indicating the same initial actuation force at the 100% position of the gap G1, the ratio is 4 at the 0% position of the gap G1 at the end of the actuating operation of the plunger. That is, since the existing device acquires the initial actuation force at the same level as in the present invention by increasing the magnitudes of the magnetomotive forces, the existing device requires an inefficiently large amount of energy, and also increases the shock at the end of the actuating operation at the 0% position of the gap G1.

In this case, when the electromagnetic device of the present invention requires an operating current of 5A, the existing device requires an operating current of 10A. To supply the operating current of 10A necessitates conductors having large sectional areas, and thereby increases the size of the coils formed by the conductors. In accordance with the increase in the size of the coils, the length of magnetic paths around the coils becomes longer, and in accordance with the increase in the length, magnetic reluctances of the magnetic paths become larger. To compensate for the increase in the magnetic reluctances, sectional areas of the magnetic paths need to be increased. Thus, the existing device involves size increase.

As mentioned above, in such existing electromagnetic device, the magnetomotive forces are inefficiently applied for starting the plunger. Therefore, to make up for such inefficiency, such existing electromagnetic device requires exciting coils of large size for generating large magnetomotive forces, and also requires a plunger and other magnetic path elements having large sectional areas to prevent magnetic saturation of large magnetic fluxes caused by the large magnetomotive forces. Thus, such existing electromagnetic device involves size increase and cost increase. Besides, such existing electromagnetic device requires other external components of large sizes incurring high costs, such as a cable of large diameter having a large current-carrying capacity for avoiding a voltage drop in large current.

Further, in the present invention, the first magnetic path 10 is arranged to have the magnetic reluctance smaller than the magnetic reluctance of the second magnetic path 11 so as to facilitate the repulsion and the turning of the starting flux Φ8' toward the first magnetic path 10. Therefore, the electromagnetic device of this embodiment requires only a small amount of power, and can be made small in size.

Thus, in the course of actuating the plunger 4, the electromagnetic device of the first embodiment uses all of the magnetic fluxes effectively as the actuating force in a wide range in the magnetic path. Therefore, the electromagnetic device of this embodiment incurs only a small degree of loss of magnetic fluxes, and therefore improves efficiency of the magnetic fluxes in actuating the plunger. Thus, the electromagnetic device of this embodiment can achieve a large magnetic attraction with a small amount of power. Hence, the electromagnetic device of this embodiment can operate with a small amount of energy, and also can be made small in size. In accordance with such energy and size reduction, the electromagnetic device of this embodiment also enables reduction in size and capacity of other components, such as a power unit and a cable necessary for the device, and therefore is advantageous in total cost reduction.

(2) EMBODIMENT 2

Figure 7:
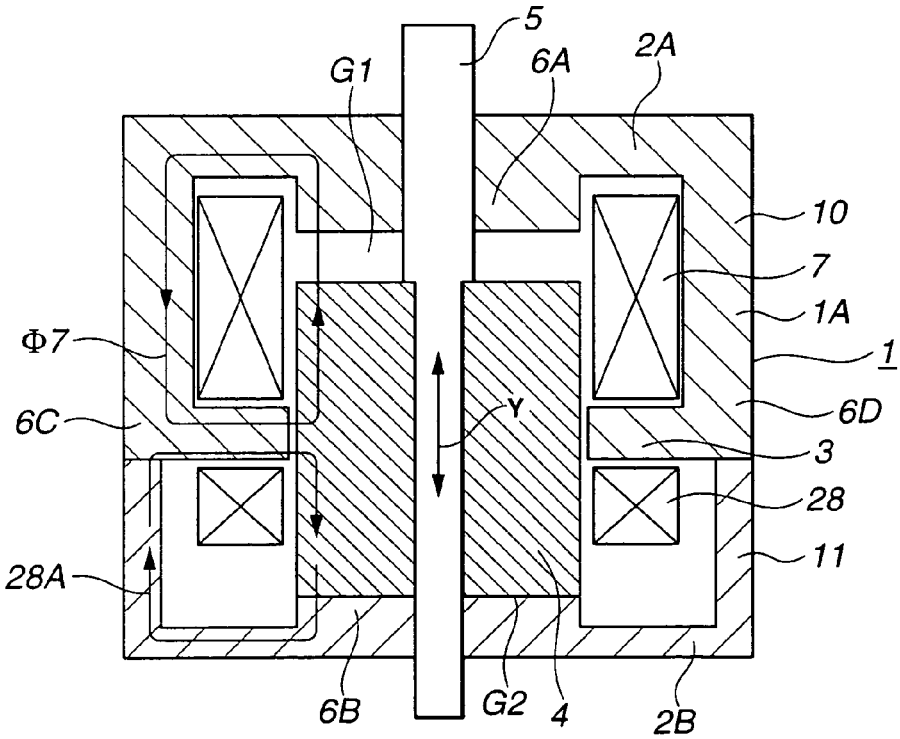
FIG. 7 is a sectional side view of an electromagnetic device using a delayed effect according to a second embodiment of the present invention.

FIG. 7 is a sectional view showing a structure of an electromagnetic device using a delayed effect. The electromagnetic device according to a second embodiment of the present invention delays the start of the actuation of the plunger 4, and thereby achieves a large magnetic attraction.

As shown in FIG. 7, the electromagnetic device according to the second embodiment includes a delay coil 28 in place of the starting coil 8 of FIG. 1. The attraction coil 7 is arranged to be capable of generating a magnetomotive force greater than a magnetomotive force of the delay coil 28. The delay coil 28 is wound in a winding direction opposite to the winding direction of the attraction coil 7. Therefore, the flux Φ7 of the attraction coil 7 and flux Φ28 of the delay coil 28 flow in directions counteracting each other. Thus, the delay coil 28 is wound around so as to generate the flux Φ28 counteracting the flux Φ7 of the attraction coil 7. In the example of FIG. 7, there is no repulsion coil 9.

The electromagnetic device of FIG. 7 temporarily delays the start of the actuation of the plunger 4 during a period in which the flux Φ7 generated by the attraction coil 7 and the flux Φ28 generated by the delay coil 28 counteract each other. During this period, the attraction coil 7 is supplied with a larger exciting current. When the magnetomotive force of the attraction coil 7 becomes greater than the magnetomotive force of the delay coil 28, and the balance between the flux Φ7 and the flux Φ28 is lost, the electromagnetic device actuates the plunger 4 immediately.

If the actuation of the plunger is started at the time of the generation of the magnetic fluxes as in the above-described example of the existing electromagnetic device, the magnitude of the magnetomotive forces, which is a product of the winding number of each of the coils and the supplied current, has to be determined so as to achieve a force required for starting the plunger at the time of the generation of the magnetic fluxes. Therefore, in order to achieve a large magnetic attraction even at the time of the generation of the magnetic fluxes, the device needs to be made large in size, and requires a large amount of power.

By contrast, the electromagnetic device of the second embodiment delays the start of the actuation of the plunger 4 by using the delay coil 28, and thus is capable of supplying the attraction coil 7 with an exciting current larger by an amount corresponding to the delay time. Therefore, the electromagnetic device of FIG. 7 can promote the actuation of the plunger 4 with a large magnetomotive force generated by the attraction coil 7. Thus, the electromagnetic device of this embodiment can achieve a large magnetic attraction with a small amount of power, and thus can be made small in size. Assuming that the existing bidirectional electromagnetic device requires an electric power of 10 to achieve an magnetic attraction required to start the actuation of the plunger, the electromagnetic device of this embodiment requires only an electric power of 2~5 to achieve such magnetic attraction to start the actuation of the plunger.

(3) EMBODIMENT 3

Figure 8:
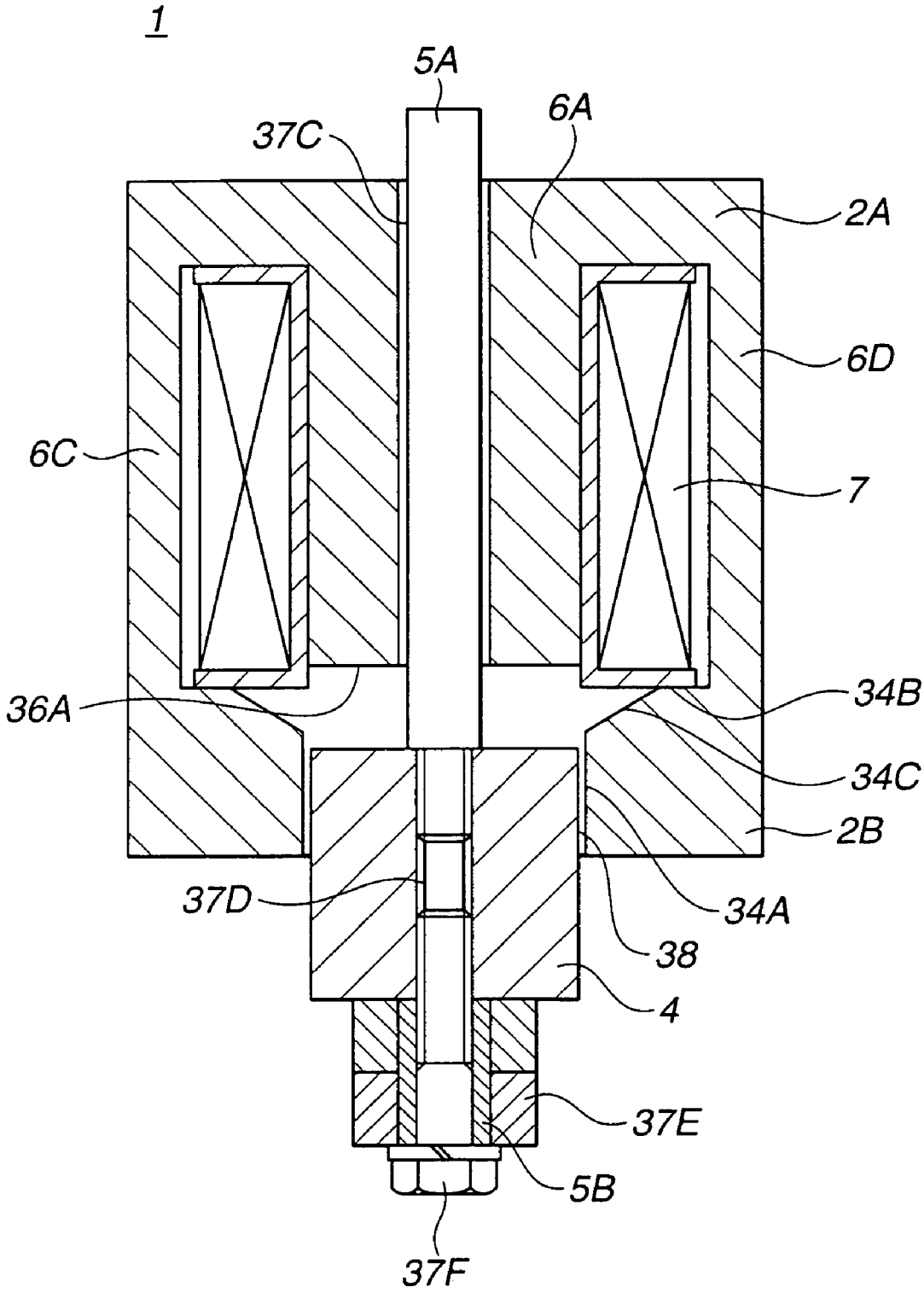
FIG. 8 is a sectional side view of an electromagnetic device according to a third embodiment of the present invention.
Figure 9:
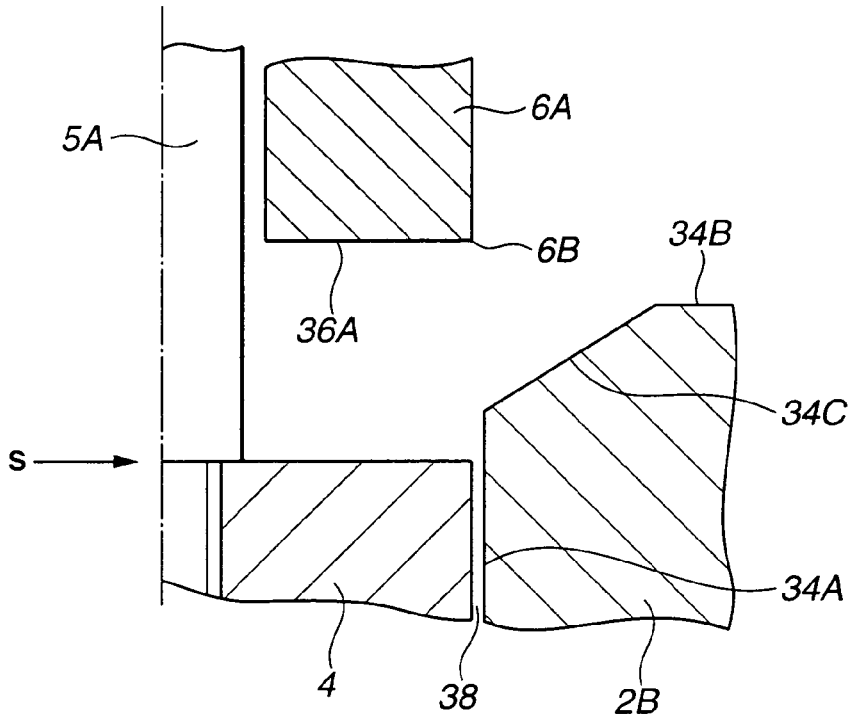
FIG. 9 is a partial sectional view showing a lower central part of the electromagnetic device of FIG. 8.
Figure 10:
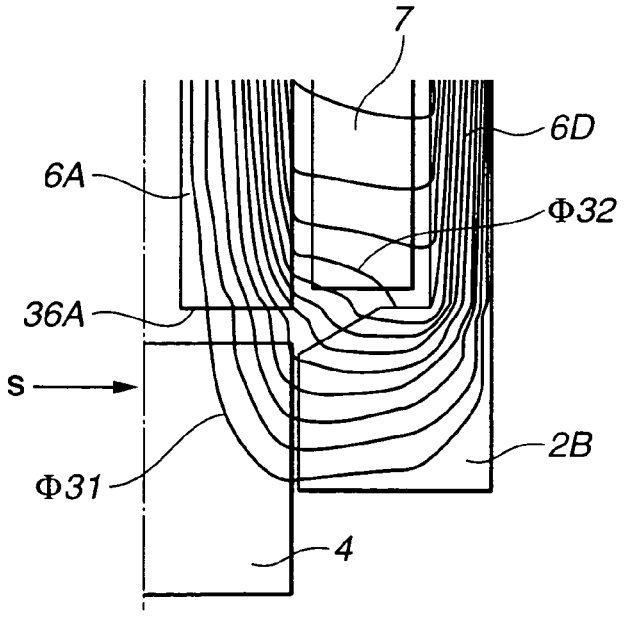
FIG. 10 is a partial sectional view showing flow of magnetic fluxes in the lower central part of the electromagnetic device of FIG. 9.
Figure 11:
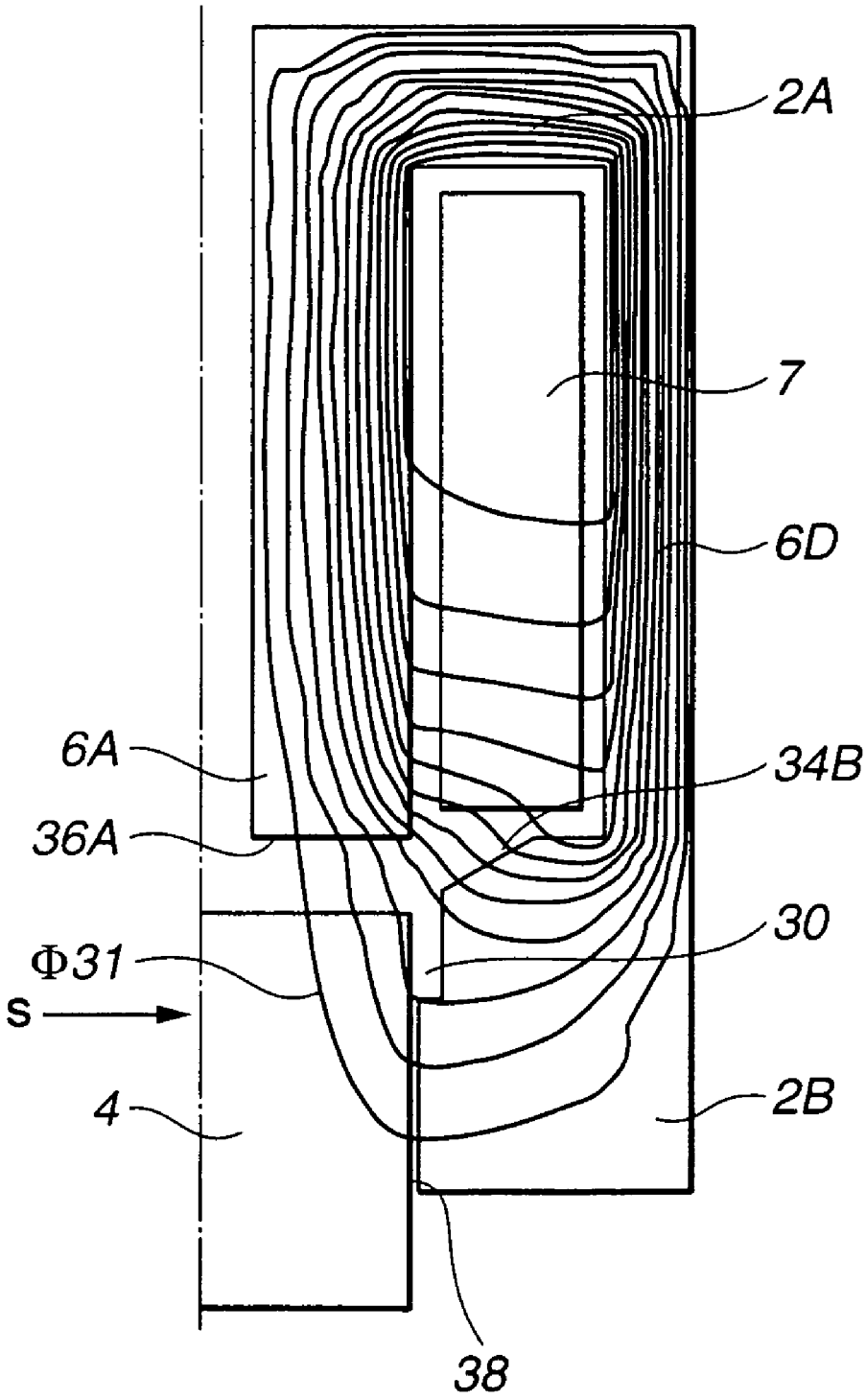
FIG. 11 is a partial sectional view showing flow of magnetic fluxes in a lower central part of a variation of the electromagnetic device of FIG. 8.

FIG. 8 is a sectional view showing a structure of an electromagnetic device according to a third embodiment of the present invention. FIGS. 9 to 11 are partial sectional views each showing a part of the electromagnetic device of FIG. 8. The electromagnetic device of this embodiment includes a center hole or passage part 38 extending through the lower second magnetic path part 2B. The central magnetic path part or central leg part 6A extends axially inward from the central part of the first magnetic path part 2A, deep into the attraction coil 7, toward the passage part 38. The lower second magnetic path part 2B includes a second magnetic path inside face 34A defining the passage part 38, and a second magnetic path upper end face 34B opposing a central leg lower end 36A of the central leg part 6A. The plunger 4 moves in the passage part 38 from an actuation start position S. The actuation start position S is located in proximity of the second magnetic path part 2B, axially between the second magnetic path inside face 34A and the second magnetic path upper end face 34B, as shown in FIG. 9.

In this arrangement, leakage magnetic flux Φ32 is magnetic flux which occurs mainly between the central leg lower end 36A and the second magnetic path part 2B. The movement of the plunger 4 from the actuation start position S changes the balance of magnetic reluctances, and the leakage magnetic flux Φ32 changes direction of flow to a part between the central leg part 6A and the plunger 4 where the magnetic reluctance becomes relatively small, and the leakage magnetic flux Φ32 becomes effective magnetic flux composing an attraction force moving the plunger 4, as shown in FIG. 10. Thus, the electromagnetic device of this embodiment changes the leakage magnetic flux Φ32 to the effective magnetic flux Φ31, and thereby increases the attraction force. Hence, the electromagnetic device of this embodiment can be made smaller in size by a degree that the effective magnetic flux adds to the attraction force.

The leakage magnetic flux Φ32 can be changed smoothly to the effective magnetic flux Φ31 by arranging the actuation start position S at the position in proximity of the second magnetic path part 2B as mentioned above, by chamfering the second magnetic path part 2B to form an inclined face (or conical face) 34C between the second magnetic path inside face 34A and the second magnetic path upper end face 34B, or by forming a receding part 30 in an upper part of the second magnetic path inside face 34A as shown in FIG. 11. The receding part 30 is cylindrical and has a diameter larger than a diameter of the cylindrical passage part 38 surrounded by the second magnetic path inside face 34A.

In this example, by forming the inclined face 34C, leakage magnetic flux occurring in a space containing the coil 7 successively shifts to the inclined face 34C, and continues to supplement the leakage magnetic flux Φ32. Therefore, the leakage magnetic flux Φ32 continuously supplies the effective magnetic flux in accordance with the movement of the plunger 4, and thereby generates an even larger attraction force for the plunger 4. Thus, the electromagnetic device of this embodiment can be made even smaller.

The receding part 30 increases the magnetic reluctance at the second magnetic path part 2B opposing the lower end 36A, and thereby forces the leakage magnetic flux Φ32 to flow via the second magnetic path part 2B to the lower end 36A. Between the lower end 36A and the plunger 4, the leakage magnetic flux Φ32 becomes effective magnetic flux, and thereby increases the attraction force.

Figure 12:
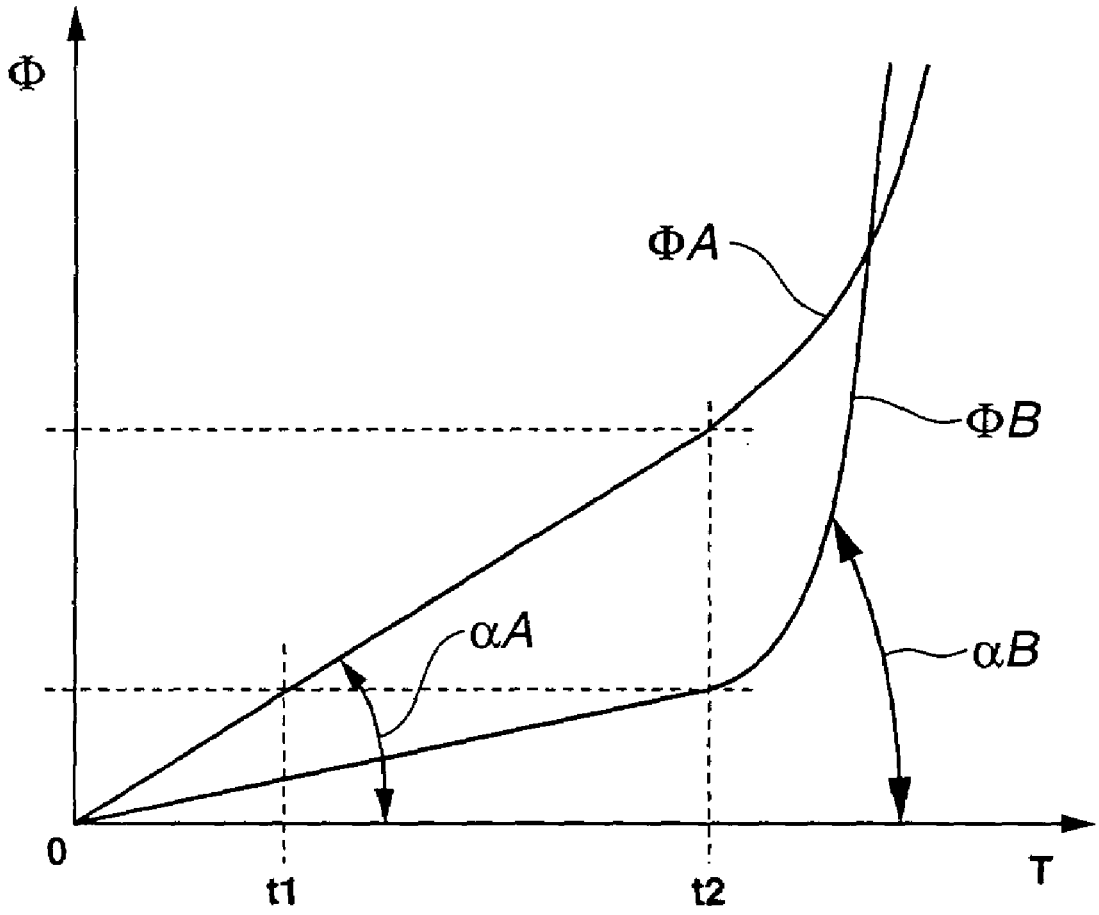
FIG. 12 is a characteristic diagram showing relations between an energization time of an attraction coil and an effective magnetic flux in the electromagnetic device of FIG. 8.

FIG. 12 is a magnetic characteristic diagram showing relations between an energization time T and an effective magnetic flux Φ. A characteristic curve ΦA of the existing electromagnetic device increases proportionately until the curve ΦA indicates an amount of magnetic flux corresponding to approximately 70% of maximum current of the attraction coil 7, and thereafter indicates saturation. The characteristic curve ΦA indicates an amount of effective magnetic flux corresponding to the force starting the plunger 4, at a time t1 which is in the region of the proportionate increase.

Since the electromagnetic device of the present invention accumulates the leakage magnetic flux Φ32, and thus initially produces a small amount of effective magnetic flux. Accordingly, a characteristic curve ΦB of the electromagnetic device of the present invention increases moderately to the level of above-mentioned effective magnetic flux corresponding to the force starting the plunger 4 until a delayed time t2. After the delayed time t2, the leakage magnetic flux Φ32 is sharply changed to the effective magnetic flux Φ31; and accordingly, the characteristic curve ΦB indicates a sharp increase of the effective magnetic flux.

Thus, at the delayed time t2, the movement of the plunger 4 from the actuation start position S changes the balance of magnetic reluctances, and the leakage magnetic flux Φ32 changes direction of flow to a part between the central leg part 6A and the plunger 4 where the magnetic reluctance becomes relatively small. Then, the leakage magnetic flux Φ32 becomes effective magnetic flux adding to the attraction force moving the plunger 4. Thus, the effective magnetic flux Φ31 increases sharply, and thereby increases the attraction force. Therefore, the characteristic curve ΦB of the present invention indicates a sharper increase of the effective magnetic flux Φ31 than the characteristic curve ΦA of the existing electromagnetic device.

As shown in FIG. 12, the characteristic curve ΦB of the present invention exhibits a gradient αB larger than a gradient αA of the characteristic curve ΦA of the existing electromagnetic device, after each of the characteristic curves indicates the amount of the effective magnetic flux corresponding to the force starting the plunger. This larger gradient αB shows that the electromagnetic device of the present invention actuates the plunger 4 at a speed becoming higher in accordance with the increase of the attraction force by the sharply growing effective magnetic flux. Besides, for example, when the electromagnetic device of the present invention is applied in controlling a breaker, the electromagnetic device operates with a small current value having an attenuated direct-current component resulting from a breaking operation to a short-circuit current. In this case, the electromagnetic device can operate with such small current value because the delayed time t2 is longer than the delayed time t1. Thus, the electromagnetic device of this embodiment and a controller of the breaker can be made smaller in size.

For the purpose of delaying the time for starting the plunger 4, the electromagnetic device of this embodiment includes a thread groove 37D, and a weight or bias member 37E. The thread groove 37D is provided in a through hole extending through the plunger 4. Upper and lower plunger rods 5A and 5B project from the upper and lower ends of the plunger 4. A through hole 37C extends through the first magnetic path part 2A and the central leg part 6A. The upper plunger rod 5A is fixed to the plunger 4 by being inserted through the through hole 37C and into an upper portion of the thread groove 37D. The lower plunger rod 5B is fixed to the plunger 4 by setting the weight 37E around the lower plunger rod 5B, placing a bolt 37F through the weight 37E and fixing the bolt 37F into a lower portion of the thread groove 37D.

The weight 37E delays the start of the plunger 4 until the current used for the actuation becomes larger than or equal to 70% of maximum current of the attraction coil 7, and thereby makes the effective magnetic flux small and makes the leakage magnetic flux large in the delayed period. The force starting the plunger 4 can be adjusted by attaching or detaching the weight 37E to vary the level of the force required for starting the actuation. Thus, the electromagnetic device of this embodiment uses the weight 37E for adjusting the attraction force and the time required for starting the plunger 4.

According to this third embodiment, the electromagnetic device changes the leakage magnetic flux Φ32 to the effective magnetic flux Φ31, and thus increases the attraction force with a small amount of electric current. Hence, the delayed electromagnetic device of this embodiment can operate at a high speed in accordance with the increased attraction force; and the electromagnetic device, the breaker and its controller can be made small in size in accordance with the small electric current.

(4) EMBODIMENT 4

Figure 13:
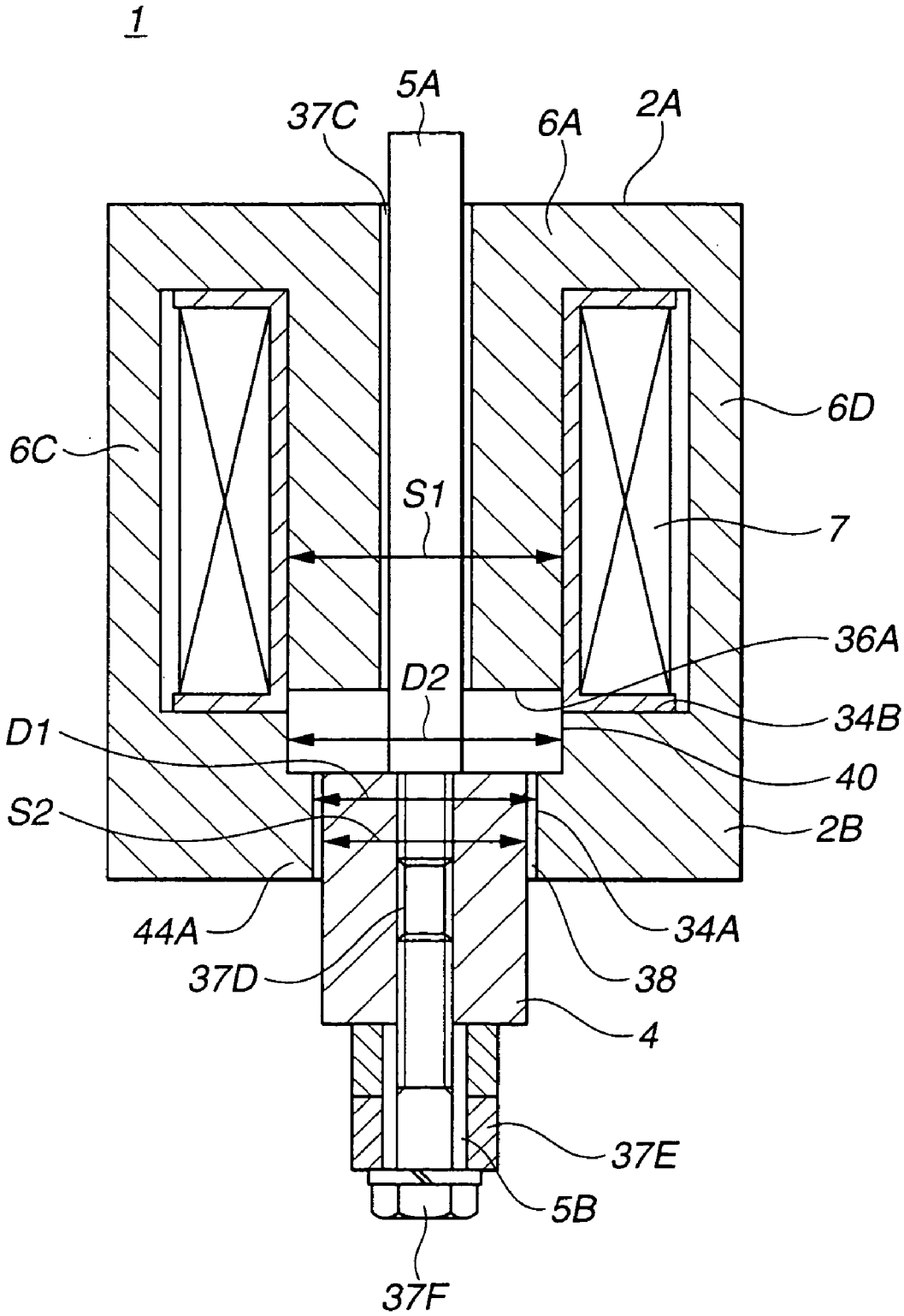
FIG. 13 is a sectional side view of an electromagnetic device according to a fourth embodiment of the present invention.
Figure 14:
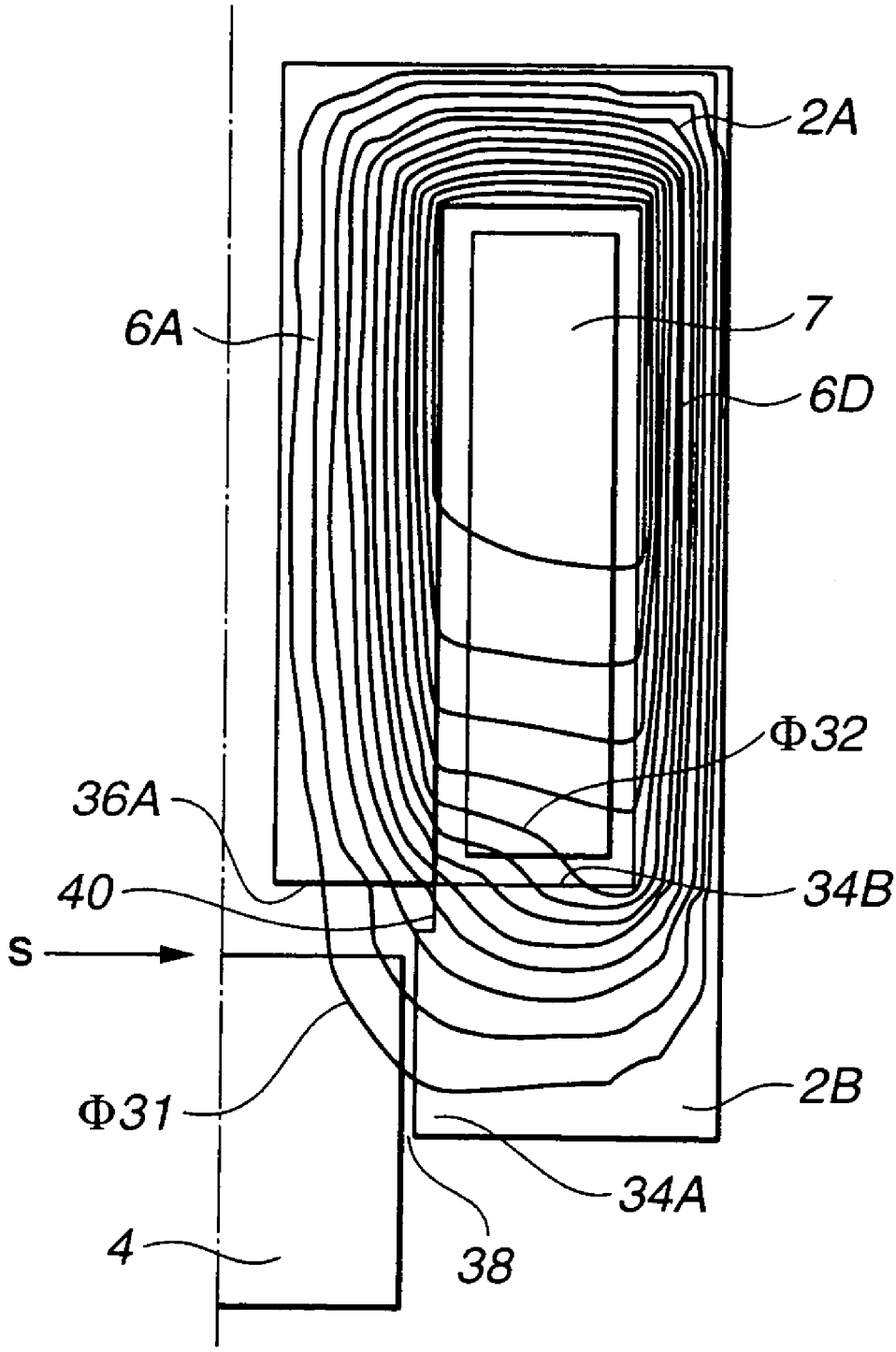
FIG. 14 is a partial sectional view showing flow of magnetic fluxes in a lower central part of the electromagnetic device of FIG. 13.

FIG. 13 is a sectional view showing a structure of an electromagnetic device according to a fourth embodiment of the present invention. FIG. 14 is a partial sectional view showing a part of the electromagnetic device of FIG. 13. The electromagnetic device of this embodiment changes leakage magnetic flux to effective magnetic flux as in the third embodiment.

In the electromagnetic device of FIG. 13, the central leg part 6A has a sectional area S1 larger than a sectional area S2 of the plunger 4. The lower second magnetic path part 2B includes a projecting portion 44A projecting radially toward the passage part 38, and a receding part 40 formed above the projecting portion 44A. The receding part 40 is cylindrical and has a diameter D2 larger than a diameter D1 of the cylindrical passage part 38 surrounded by the projecting portion 44A. The receding part 40 is positioned between the projecting portion 44A and the central leg part 6A. Thus, an upper end face of the projecting portion 44A opposes the central leg part 6A across the receding part 40, i.e., the projecting portion 44A laps the central leg part 6A across the receding part 40.

In this fourth embodiment, when the movement of the plunger 4 changes the balance of magnetic reluctances, the leakage magnetic flux Φ32 occurring mainly between the central leg lower end 36A and the second magnetic path part 2B changes direction of flow to a part between the central leg part 6A and the plunger 4 where the magnetic reluctance becomes relatively small, and the leakage magnetic flux Φ32 becomes the effective magnetic flux Φ31 composing the attraction force moving the plunger 4, as shown in FIG. 14. In this arrangement, the central leg part 6A attracts a larger portion of the effective magnetic flux Φ31 due to the sectional area S1 larger than the sectional area S2 of the plunger 4. Thus, the electromagnetic device of this embodiment changes the leakage magnetic flux Φ32 to the effective magnetic flux Φ31, and effectively increases the attraction force. Hence, the electromagnetic device of this embodiment can be made smaller in size by a degree that the effective magnetic flux adds to the attraction force.

Since the central leg part 6A has the sectional area S1 larger than the sectional area S2 of the plunger 4, the central leg part 6A attracts a larger portion of the effective magnetic flux Φ31 from the plunger 4, and thereby further effectively increases the attraction force. Thus, the electromagnetic device of this embodiment can be made smaller in size by the degree that the attraction force is further increased.

Besides, as mentioned above, the projecting portion 44A of the lower second magnetic path part 2B laps the central leg part 6A, and the receding part 40 increases the magnetic reluctance at the second magnetic path part 2B opposing the lower end 36A. This arrangement prevents the leakage magnetic flux Φ32 from leaking to the lower end 36A without passing through the plunger 4, and instead facilitates a large portion of the leakage magnetic flux Φ32 to flow to the plunger 4 via the projecting portion 44A. Thus, the leakage magnetic flux Φ32 increases the effective magnetic flux Φ31 at the plunger 4, and the effective magnetic flux Φ31 increases the attraction force. Thus, the electromagnetic device of this embodiment can be made smaller in size in accordance with the increase in the attraction force.

In order to achieve a similar magnetic characteristic represented by the characteristic curve ΦB of the present invention shown in FIG. 12, the weight 37E is attached or detached from the plunger 4, and thereby varies the force required for starting the plunger 4, and adjusts the time delayed until the start of the plunger 4. During the delayed time, the magnitude of the exciting current supplied to the attraction coil 7 is adjusted, and the attraction coil 7 generates magnetic flux adjusted in accordance with the magnitude of the exciting current. In accordance with the adjusted magnetic flux, the electromagnetic device can adjust the attraction force and the time required for starting the plunger 4.

According to this fourth embodiment, the electromagnetic device increases the attraction force with a small amount of electric current by effectively changing the leakage magnetic flux Φ32 to the effective magnetic flux Φ31. Thus, the electromagnetic device of this embodiment can be made small in size in accordance with the small electric current, and can be used for a controller of the breaker, as in the third embodiment. Hence, the delayed small-size electromagnetic device of this embodiment can operate at a high speed in accordance with the increased attraction force with a small amount of electric current.

(5) EMBODIMENT 5

Figure 15:
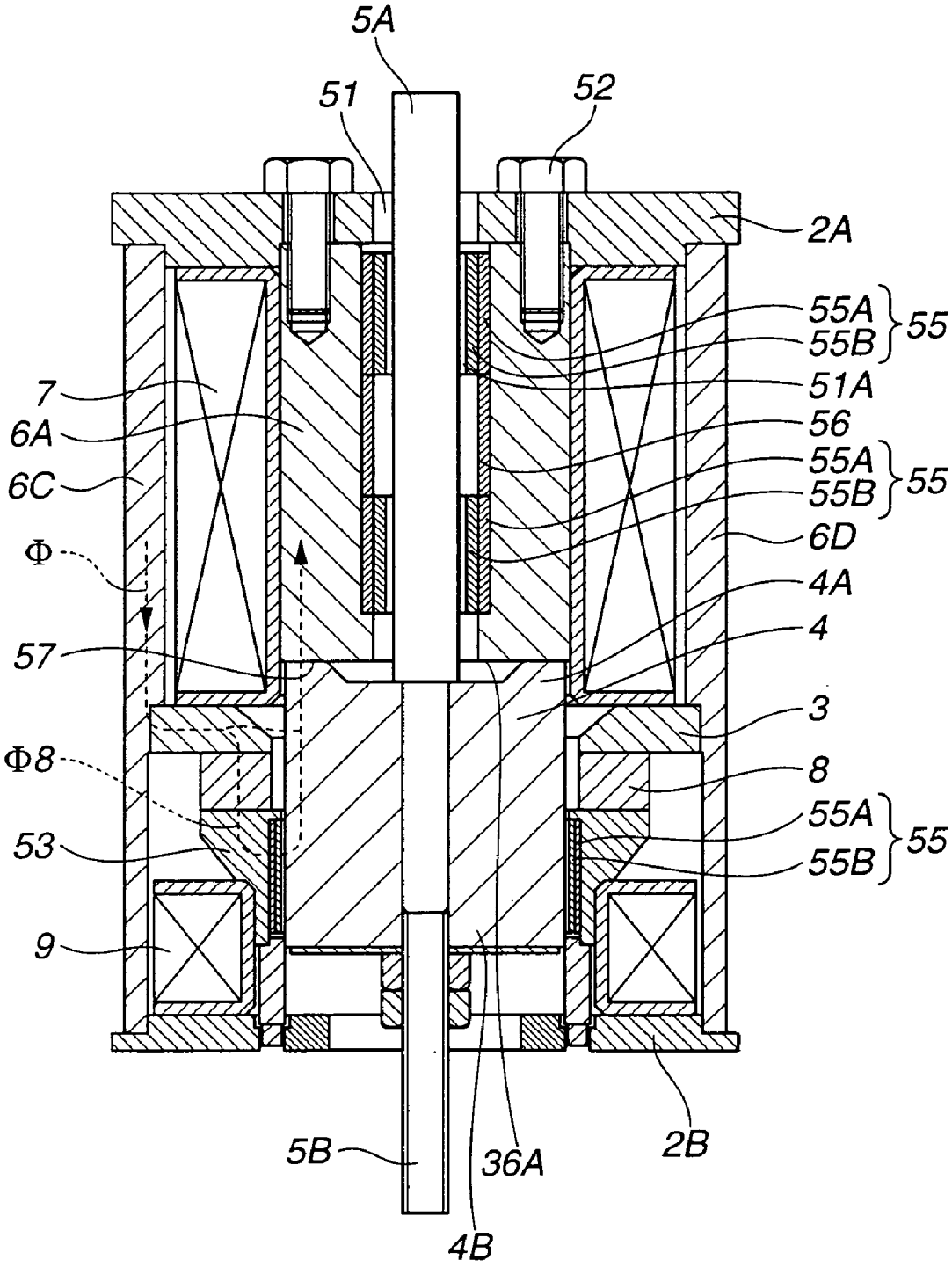
FIG. 15 is a sectional side view of an electromagnetic device according to a fifth embodiment of the present invention.
Figure 16:
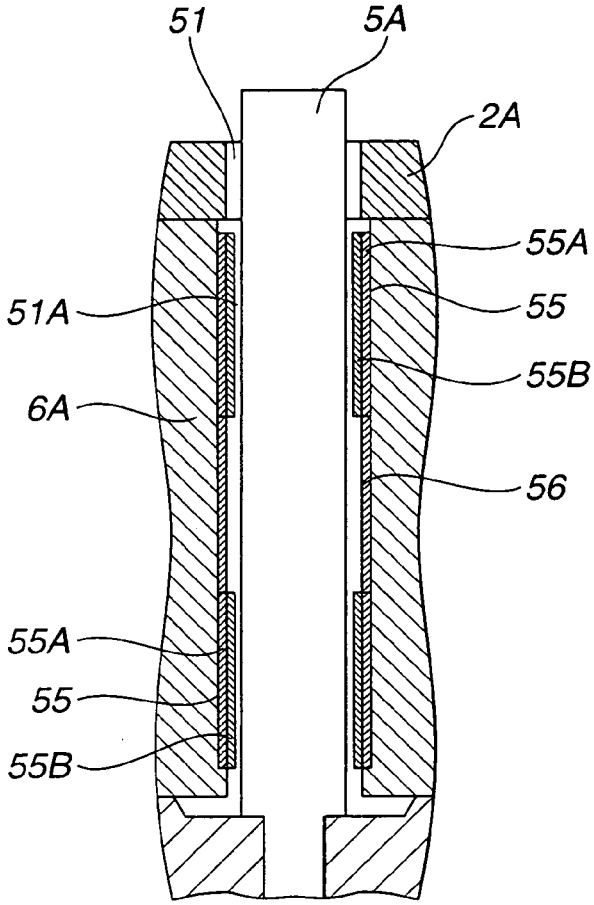
FIG. 16 is a partial sectional view showing a part of the electromagnetic device of FIG. 15 in which metal rings are disposed between a rod hole and a plunger rod.
Figure 17:
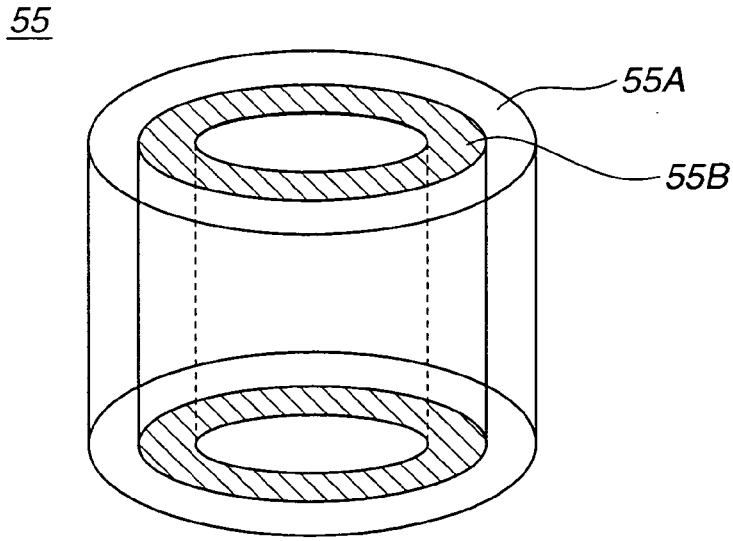
FIG. 17 is a perspective view showing the metal rings of FIG. 15.

FIG. 15 is a sectional view showing a structure of an electromagnetic device according to a fifth embodiment of the present invention. FIG. 16 is a partial sectional view showing a part of the electromagnetic device of FIG. 15. FIG. 17 is a perspective view showing each of metal rings provided in the electromagnetic device of FIG. 15. The electromagnetic device of FIG. 15 has basically the same structure as the electromagnetic device of FIG. 1. In addition, the electromagnetic device of FIG. 15 includes metal rings or magnetic members 55 disposed in a rod hole or rod passage 51 extending through the first magnetic path part 2A and the central magnetic path part 6A, and a spacer 56 placed between the upper and lower metal rings 55. Each of the metal rings 55 includes a magnetic plate or magnetic layer 55A and a sliding layer 55B. The magnetic plate 55A is made of a magnetic material shaped in a thin annular form. The sliding layer 55B is provided on a surface of the magnetic plate 55A opposing the plunger rod 5A inserted in the rod hole 51.

The sliding layer 55B is made of a slidable material lubricative in itself, having a small friction coefficient, and being not easily worn. For example, tetrafluoroethylene resin (fluoro resin), polyethylene resin, silicone resin, or polyacetal resin may be used as such slidable material. In this embodiment, the sliding layer 55B is made of fluoro resin. The metal ring 55 may be replaced by other magnetic metal member, such as a metal piece, shaped in other form than the annular form, as long as the member includes a magnetic material part and a sliding layer, or only a magnetic material part.

The plunger rod 5A is inserted in the rod hole or rod passage 51, and the metal rings 55 are inserted between the rod hole 51 and the plunger rod 5A. In this state, the first magnetic path part 2A is placed on upper ends of the portions 6C and 6D of the side leg part; and bolts 52 are screwed through the first magnetic path part 2A into the central magnetic path part 6A, and thereby support the first magnetic path part 2A and the central magnetic path part 6A.

Then, when the attraction coil 7 and the repulsion coil 9 are supplied with exciting current, the attraction flux Φ7 and the repulsion flux Φ9 generated by the supplied exciting current and the starting flux Φ8 generated from the starting flux generating section 8 circulate in the magnetic path 1 via the central magnetic path part 6A, and generate electromagnetic attraction which attracts the plunger 4 to the lower end 36A, as described above in the first embodiment.

A gap 51A between the rod hole 51 and the plunger rod 5A is easily narrowed by thickness of the metal rings 55 inserted between the rod hole 51 and the plunger rod 5A.

The thus-narrowed gap 51A prevents inclination of the plunger rod 5A. Therefore, at a contact face 57 at which the plunger 4 contacts the lower end 36A, a contact area between the plunger 4 and the lower end 36A increases, and to the contrary, a gap between the plunger 4 and the lower end 36A at the contact face 57 decreases. This contact between the plunger 4 and the lower end 36A decreases probability of causing damage and magnetic flux loss at the contact face 57, and thereby improves life duration of the electromagnetic device of this embodiment.

When the plunger rod 5A moves in the rod hole 51 while being in contact with the sliding layer 55B, the lubricity of the sliding layer 55B smoothes the movement of the plunger rod 5A, and thereby prevents the plunger rod 5A from undergoing extra load, and reduces an amount of power required for the operation of the electromagnetic device of this embodiment.

Since the gap 51A can be easily narrowed by simply inserting the metal rings 55 into the rod hole 51, the rod hole 51 does not need to be formed in higher precision. The metal rings 55 of different sizes may be inserted into the rod hole 51 for easy adjustment of the width of the gap 51A.

Since the metal rings 55 are provided in the magnetic path 1, the metal rings 55 can be continually held on an inner surface of the rod hole 51 by the magnetic attraction of the magnetic path 1. Due to this magnetic attraction, the metal rings 55 are kept from moving and continue to be held on the inner surface of the rod hole 51 even when the plunger rod 5A moves in contact with the sliding layer 55B.

As mentioned above, the starting flux generating section 8 may be realized as a permanent magnet. In this case, the magnetic flux from the permanent magnet circulating in the magnetic path 1 generates magnetic attraction which continually holds the metal rings 55 on the inner surface of the rod hole 51, or on a surface of a hereinafter-described supporting metal member 53 or on a part of the magnetic path 1, even when the attraction coil 7 and the repulsion coil 9 are not supplied with exciting current. When the electromagnetic device includes only the attraction coil 7 and the repulsion coil 9, the metal rings 55 can be continually held in the magnetic path 1 by residual flux. Thus, the electromagnetic device of this embodiment can hold the metal rings 55 with a simple structure not including an extra supporting member.

As mentioned above, the electromagnetic device of FIG. 15 includes the supporting metal member 53. The supporting metal member 53 is disposed between the starting coil 8 and the repulsion coil 9. The metal ring 55 including the sliding layer 55B opposite the plunger 4 is fixed on a surface of the supporting metal member 53 opposing the plunger 4. Besides, the metal ring 55 may be fixed on the starting coil 8, or on a part of the magnetic path 1 opposing the plunger 4. The metal ring 55 disposed opposite the plunger 4 exhibits similar effects to the above-described effects of the metal rings 55 disposed opposite the plunger rod 5A.

Specifically, the metal ring 55 narrows a gap between the supporting metal member 53 and the plunger 4, and prevents the plunger 4 from inclining with respect to the axial direction. Besides, the lubricity of the sliding layer 55B prevents the plunger 4 from undergoing extra load when the plunger 4 moves in contact with the sliding layer 55B, and thereby reduces an amount of power required for the operation of the electromagnetic device of this embodiment. Additionally, the metal ring 55 narrows a gap between the magnetic path 1 and the plunger 4, and thereby reduces magnetic loss in the magnetic path 1. Thus, the electromagnetic device of this embodiment can increase magnetic attraction by a degree that the metal ring 55 reduces the magnetic loss.

In this embodiment, the metal ring 55 may be replaced by other magnetic metal member, such as a metal piece, shaped in other form than the annular form, as long as the member can be used for easily narrowing the gaps, and easily adjusting the width of the gaps, as described above, and includes a magnetic material part and a sliding layer, or only a magnetic material part.

Thus, the electromagnetic device of this embodiment can decrease damage and magnetic flux loss at contact faces of either the plunger rod 5A or the plunger 4 and the opposing parts, and therefore can have an improved life duration and an increased magnetic attraction. Especially, when the electromagnetic device is designed for simply increasing the magnetic attraction, the above-mentioned magnetic metal member, such as the metal ring or the metal piece, may include only the magnetic material part. The magnetic metal member may be provided on the plunger 4.

For example, the magnetic metal member arranged to adjust the gap between the magnetic path 1 and the plunger 4 may be disposed on either or both of the plunger 4 and the magnetic path 1 within the gap. The magnetic metal member may include the sliding layer on the surface opposing either the magnetic path 1 or the plunger 4. Thus, the electromagnetic device can have a narrowed gap between the magnetic path 1 and the plunger 4.

Alternatively, the magnetic metal member arranged to adjust the gap between the magnetic path 1 and the plunger 4 may be disposed on either or both of the plunger 4 and the magnetic path 1 within the gap. The magnetic metal member includes only the magnetic material part. Thus, the electromagnetic device can have a narrowed gap between the magnetic path 1 and the plunger 4.

This application is based on prior Japanese Patent Applications No. 2003-292242 filed on Aug. 12, 2003; No. 2003-388836 filed on Nov. 19, 2003; No. 2004-170283 filed on Jun. 8, 2004; No. 2004-170284 filed on Jun. 8, 2004; and No. 2004-170285 filed on Jun. 8, 2004. The entire contents of these Japanese Patent Applications Nos. 2003-292242, 2003-388836, 2004-170283, 2004-170284, and 2004-170285 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An electromagnetic device comprising:

a magnetic path including first and second magnetic path parts, and a leg part connecting the first and second magnetic path parts;

an attraction coil disposed in the magnetic path and arranged to generate a magnetic flux;

a repulsion coil disposed in the magnetic path and arranged to generate a magnetic flux;

a plunger disposed in the magnetic path and arranged to move to and from one of the first and second magnetic path parts by at least one of electromagnetic forces of the attraction coil or the repulsion coil; and a starting flux generating section disposed between the attraction coil and the repulsion coil in the magnetic path, and arranged to generate a magnetic flux so that the magnetic flux of the starting flux generating section and the magnetic flux of the repulsion coil repulse magnetically each other at a part of the magnetic path to start the plunger, wherein the magnetic flux of the attraction coil, the magnetic flux of the repulsion coil and the magnetic flux of the starting flux generating section flow in the same direction at a start of actuation of the plunger.

2. An electromagnetic device comprising:

a magnetic path including first and second magnetic path parts, and a leg part connecting the first and second magnetic path parts;

an attraction coil disposed in the magnetic path and arranged to generate a magnetic flux;

a repulsion coil disposed in the magnetic path and arranged to generate a magnetic flux;

a plunger disposed in the magnetic path and arranged to move to and from one of the first and second magnetic path parts by at least one of electromagnetic forces of the attraction coil or the repulsion coil; and a starting flux generating section disposed between the attraction coil and the repulsion coil in the magnetic path, and arranged to generate a magnetic flux so that the magnetic flux of the starting flux generating section and the magnetic flux of the repulsion coil repulse magnetically each other at a part of the magnetic path to start the plunger, wherein the magnetic path is composed of a first magnetic path formed in a part facing the attraction coil and the starting flux generating section, and a second magnetic path formed in a part facing the repulsion coil, the first magnetic path having a magnetic reluctance smaller than a magnetic reluctance of the second magnetic path.

3. The electromagnetic device as claimed in claim 1, wherein the magnetic flux of the starting flux generating section and the magnetic flux of the repulsion coil repulse magnetically each other at a part between the second magnetic path part and the plunger.

4. The electromagnetic device as claimed in claim 1, wherein the starting flux generating section and the repulsion coil are arranged to generate magnetomotive forces approximate to each other.

5. The electromagnetic device as claimed in claim 1, wherein the attraction coil is formed by a conductor wound around a line in an axial direction.

6. The electromagnetic device as claimed in claim 5, wherein the repulsion coil is formed by a conductor wound around a line in an axial direction.

7. The electromagnetic device as claimed in claim 6, wherein the starting flux generating section is formed by a conductor wound around a radial line perpendicular to the axial direction of the attraction coil and the repulsion coil.

8. The electromagnetic device as claimed in claim 1, wherein the starting flux generating section has a magnetomotive force smaller than the magnetomotive force of the attraction coil.

9. The electromagnetic device as claimed in claim 1, wherein the repulsion coil has a magnetomotive force smaller than the magnetomotive force of the attraction coil.

10. The electromagnetic device as claimed in claim 1, further comprising central magnetic path parts formed integrally with the first and second magnetic path parts.

11. The electromagnetic device as claimed in claim 10, further comprising a gap formed between the plunger and each of the central magnetic path parts.

12. The electromagnetic device as claimed in claim 2, wherein a sectional area of the first magnetic path is larger than a sectional area of the second magnetic path.

13. The electromagnetic device as claimed in claim 2, wherein the first magnetic path and the second magnetic path are independent sections.

14. An electromagnetic device, comprising:

a magnetic path including first and second magnetic path parts, and a leg part connecting the first and second magnetic path parts;

an attraction coil disposed in the magnetic path and arranged to generate a magnetic flux;

a repulsion coil disposed in the magnetic path and arranged to generate a magnetic flux;

a plunger disposed in the magnetic path and arranged to move to and from one of the first and second magnetic path parts by at least one of electromagnetic forces of the attraction coil or the repulsion coil; and means for generating a starting magnetic flux disposed between the attraction coil and the repulsion coil in the magnetic path, so that the starting magnetic flux and the magnetic flux of the repulsion coil repulse magnetically each other at a part of the magnetic path to start the plunger, wherein the magnetic flux of the attraction coil, the magnetic flux of the repulsion coil and the starting magnetic flux flow in the same direction at a start of actuation of the plunger.

15. The electromagnetic device as claimed in claim 14, wherein the magnetic path is composed of a first magnetic path formed in a part facing the attraction coil and the means for generating a starting magnetic flux, and a second magnetic path formed in a part facing the repulsion coil, the first magnetic path having a magnetic reluctance smaller than a magnetic reluctance of the second magnetic path.

16. The electromagnetic device as claimed in claim 14, wherein the starting magnetic flux and the magnetic flux of the repulsion coil repulse magnetically each other at a part between the second magnetic path part and the plunger.

17. The electromagnetic device as claimed in claim 14, wherein the means for generating a starting magnetic flux and the repulsion coil are arranged to generate magnetomotive forces approximate to each other.

18. The electromagnetic device as claimed in claim 14, wherein the attraction coil is formed by a conductor wound around a line in an axial direction.

19. The electromagnetic device as claimed in claim 18, wherein the repulsion coil is formed by a conductor wound around a line in an axial direction.

20. The electromagnetic device as claimed in claim 19, wherein the means for generating a starting magnetic flux is formed by a conductor wound around a radial line perpendicular to the axial direction of the attraction coil and the repulsion coil.

21. The electromagnetic device as claimed in claim 14, wherein the means for generating a starting magnetic flux has a magnetomotive force smaller than the magnetomotive force of the attraction coil.

* * * * *